US007658596B2

(12) United States Patent
Wu

(10) Patent No.: US 7,658,596 B2
(45) Date of Patent: Feb. 9, 2010

(54) MINI PUMP'S NOZZLE DEVICE AND HANDHELD PORTION MADE OF DUAL MATERIAL WITH DIFFERENT HARDNESSES

(76) Inventor: Scott Wu, No. 6, Lane 176, Wu Fu Road, Wu Feng Hsiang, Taichung Hsien (TW)

( * ) Notice: Subject to any disclaimer, the term of this patent is extended or adjusted under 35 U.S.C. 154(b) by 129 days.

(21) Appl. No.: 11/953,929

(22) Filed: Dec. 11, 2007

(65) Prior Publication Data

US 2008/0193302 A1 Aug. 14, 2008

(30) Foreign Application Priority Data

Feb. 8, 2007 (TW) ..... 96202439 U

(51) Int. Cl.
*F04B 53/00* (2006.01)

(52) U.S. Cl. ..... 417/234

(58) Field of Classification Search ..... 417/234, 417/379, 469; 141/38
See application file for complete search history.

(56) References Cited

U.S. PATENT DOCUMENTS 5,026,261 A * 6/1991 Jou ..... 417/555.1
6,065,947 A * 5/2000 Wu ..... 417/526
6,164,938 A * 12/2000 Chuang ..... 417/569
6,615,704 B2 * 9/2003 Chuang ..... 92/58.1

* cited by examiner

*Primary Examiner*—Devon C Kramer
*Assistant Examiner*—Todd D Jacobs
(74) *Attorney, Agent, or Firm*—Alan Kamrath; Kamrath & Associates PA

(57) ABSTRACT

A mini pump having a body includes a head, a handheld portion extending from the head and having a groove, a nozzle device having a cover element, a nozzle and an anti-sliding element. The anti-sliding element is disposed on the head and partially received in the groove. The cover element engages the anti-sliding element to the cylinder and prevents the nozzle from coming off the body. The handheld portion and the anti-sliding element are made of resins with different hardnesses. The material of the handheld portion of the body is tougher than that of the anti-sliding element of the nozzle device.

7 Claims, 10 Drawing Sheets

MINI PUMP'S NOZZLE DEVICE AND HANDHELD PORTION MADE OF DUAL MATERIAL WITH DIFFERENT HARDNESSES

BACKGROUND OF THE INVENTION

1. Field of the Invention

The present invention relates to a nozzle device and a handheld portion for a mini pump. In particular, the nozzle device and the handheld portion are made of two kinds of materials with different hardnesses.

2. Description of the Related Art

The nozzle device for a conventional mini pump 1 is provided for inflating a bicycle tire. Referring to FIG. 10, when holding the mini pump, a user's hand might sweat. The anti-sliding portion of the nozzle device and the holding portion of the mini pump where the user holds are usually adapted to prevent the mini pump sliding on the user's hand. The conventional anti-sliding portion and the holding portion of the mini pump are usually made from bicolor resins with different hardnesses. Specifically, the anti-sliding portion that is gripped by the user's finger is preferred to be softer resin than the holding portion that is held by the user's palm so that it is comfortable for the user to operate the pump. In addition, the bicolor resin is formed by a bi-color injection molding machine. Moreover, the nozzle device of the mini pump has interior threads for engaging with the head of the mini pump, and the holding portion of the head of the mini pump also has interior threads for engaging with the tube of the mini pump. However, the bi-color injection molding machine is driven via a rotary drive. If the step of forming the threads on parts of the mini pump has to be proceeded with the step of simultaneous bi-color injection molding the resin parts of the mini pump extra power is added to the rotary drive of the bi-color injection molding machine for multiple functions. Hence, the manufacture process will become extremely complicated, and the cost will increase.

The present invention is therefore intended to obviate or at least alleviate the problems encountered in the prior art.

SUMMARY OF THE INVENTION

The present invention solves this need and other problems in the field of nozzle devices and handheld portions of mini pumps by providing, in a preferred form, a mini pump including a body having a head, a handheld portion extending from the head and having a groove, a nozzle device having a cover element, a nozzle and an anti-sliding element. The anti-sliding element is disposed on the head and is partially received in the groove. The cover element engages the anti-sliding element to the connecting end and prevents the nozzle from coming off the body.

The handheld portion and the anti-sliding element are respectively made of resins with different hardnesses. The material of the handheld portion of the body is tougher than that of the anti-sliding element of the nozzle device. When a user operates a mini pump in accordance with the present invention, the user could hold the anti-sliding element to inflate easily. When a user holds the mini pump for inflating, the user has to apply force on the pump and the user's hand might be sweating. It might cause the pump to slide on the user's hand. Hence, the soft rubber material of the anti-sliding element could prevent a sliding of the pump on the user's hand and insures operation safety.

Furthermore, the anti-sliding element and the handheld portion are respectively manufactured via injection-molding, and, then, the parts are fabricated in sequence. The method of fabrication can tighten the anti-sliding element with the body. Therefore, it is unnecessary to use the bicolor injection molding machine to produce the anti-slipping element and the handheld portion of the mini pump. It can save cost and can simplify the production process.

Other advantages, objectives and features of the present invention will become apparent from the following description referring to the attached drawings.

DETAILED DESCRIPTION OF THE PREFERRED EMBODIMENT

Figure 1:
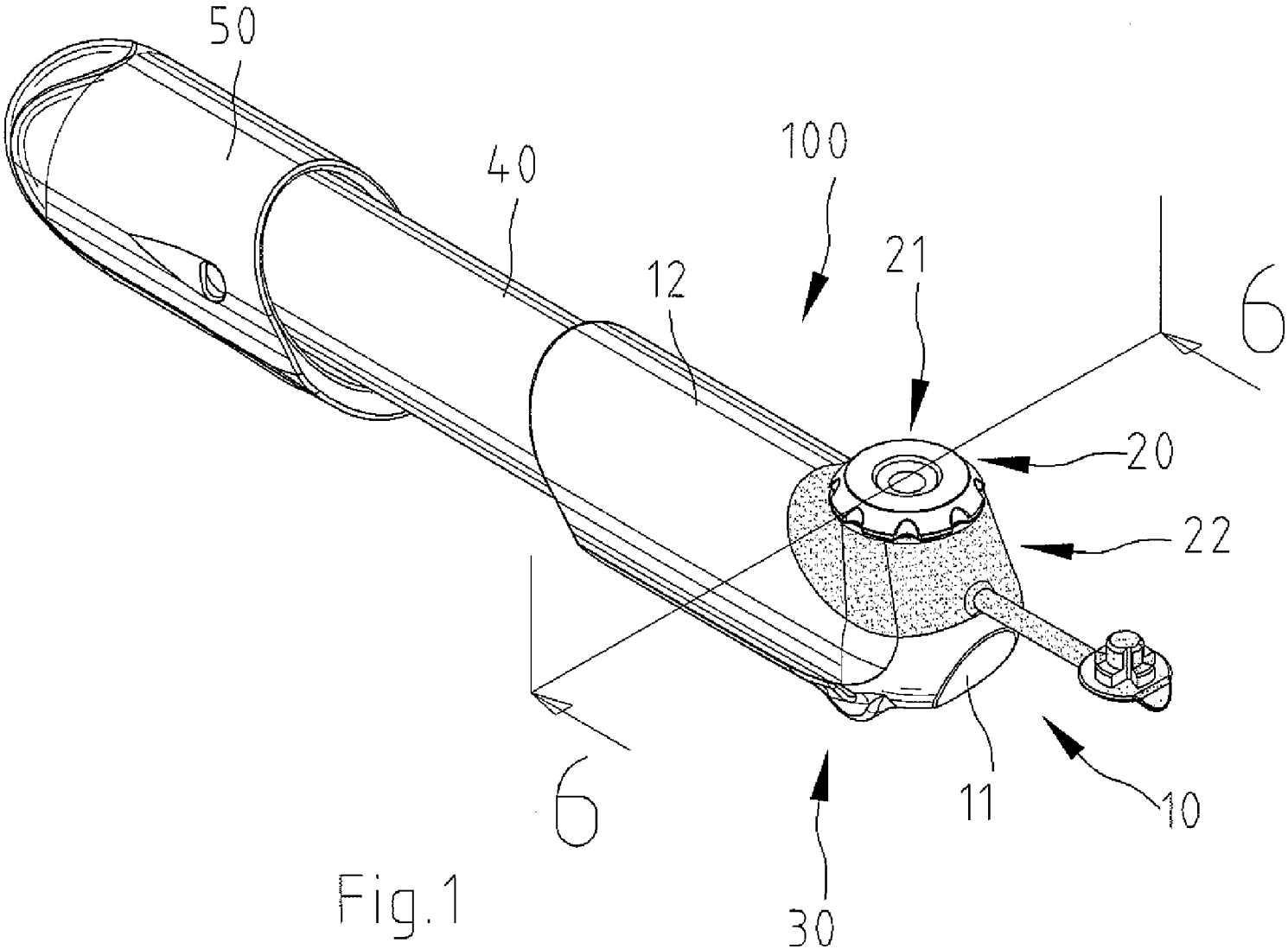
FIG. 1 is a perspective view of a mini pump in accordance with the present invention.
Figure 2:
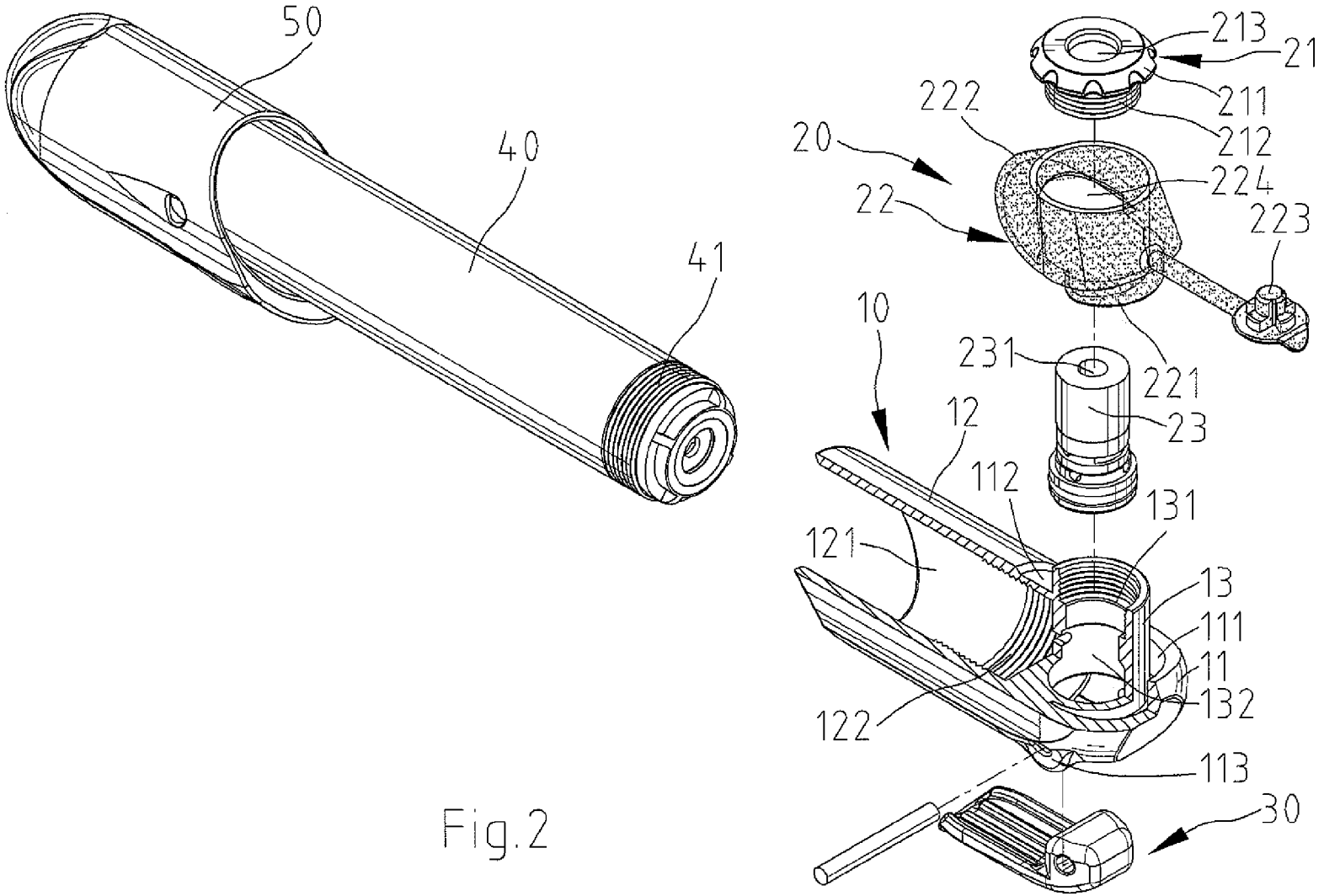
FIG. 2 is an exploded view in accordance with FIG. 1.
Figure 3:
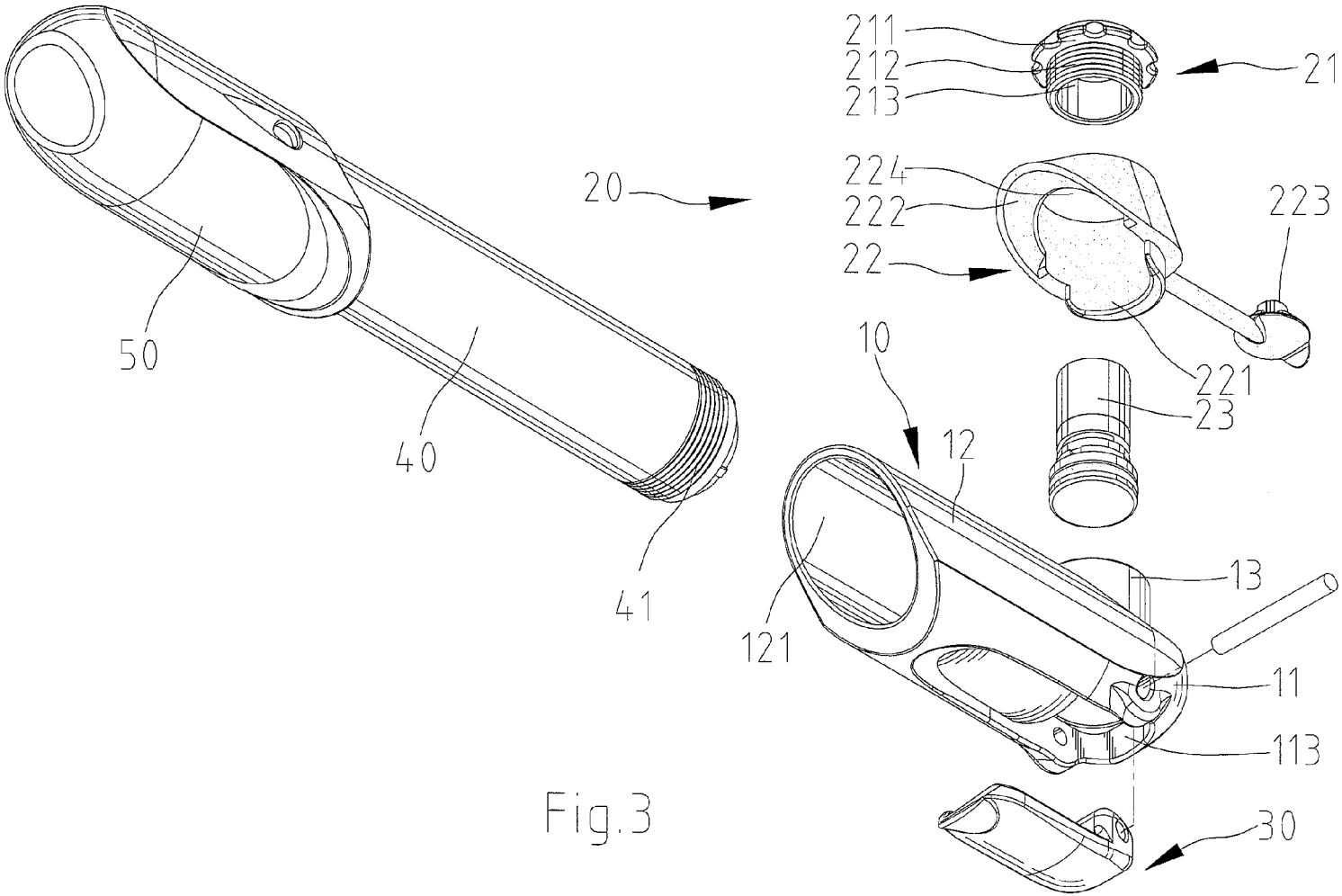
FIG. 3 is another exploded view in accordance with FIG. 1.
Figure 4:
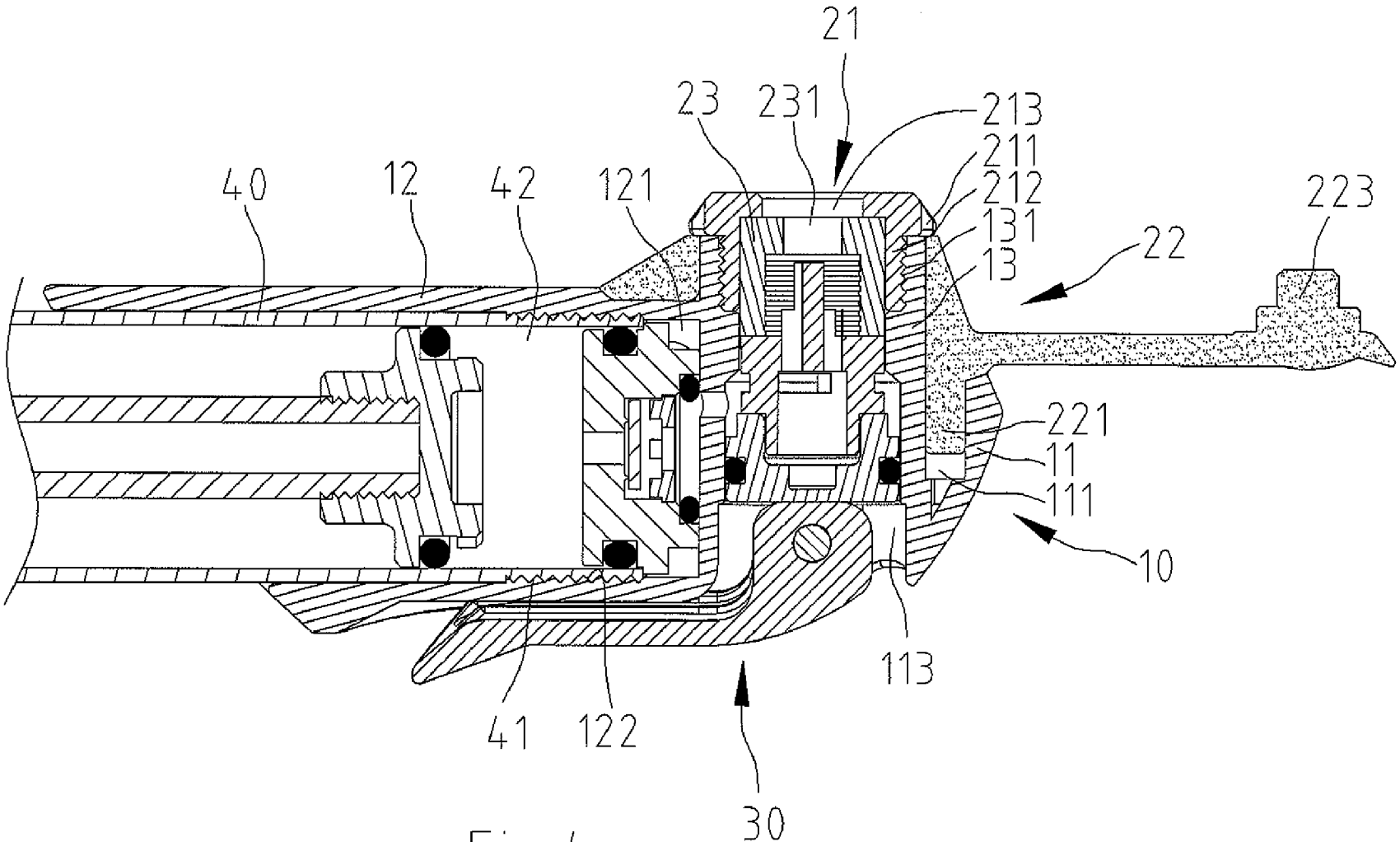
FIG. 4 is a cross-sectional view in accordance with FIG. 1.
Figure 5:
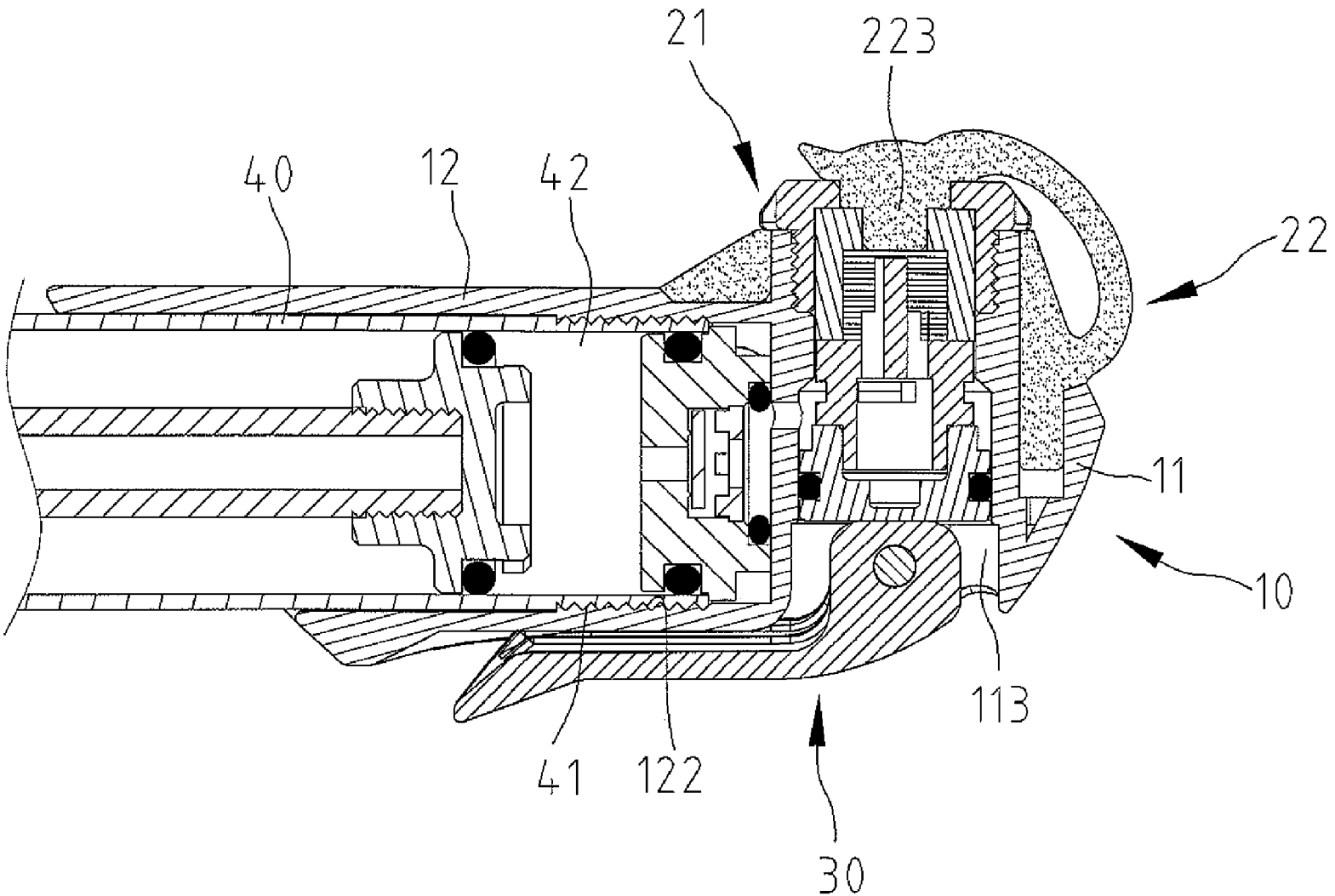
FIG. 5 is another cross-sectional view in accordance with FIG. 1, illustrating the plug element of the nozzle device inserted into the through hole of the cover element.
Figure 6:
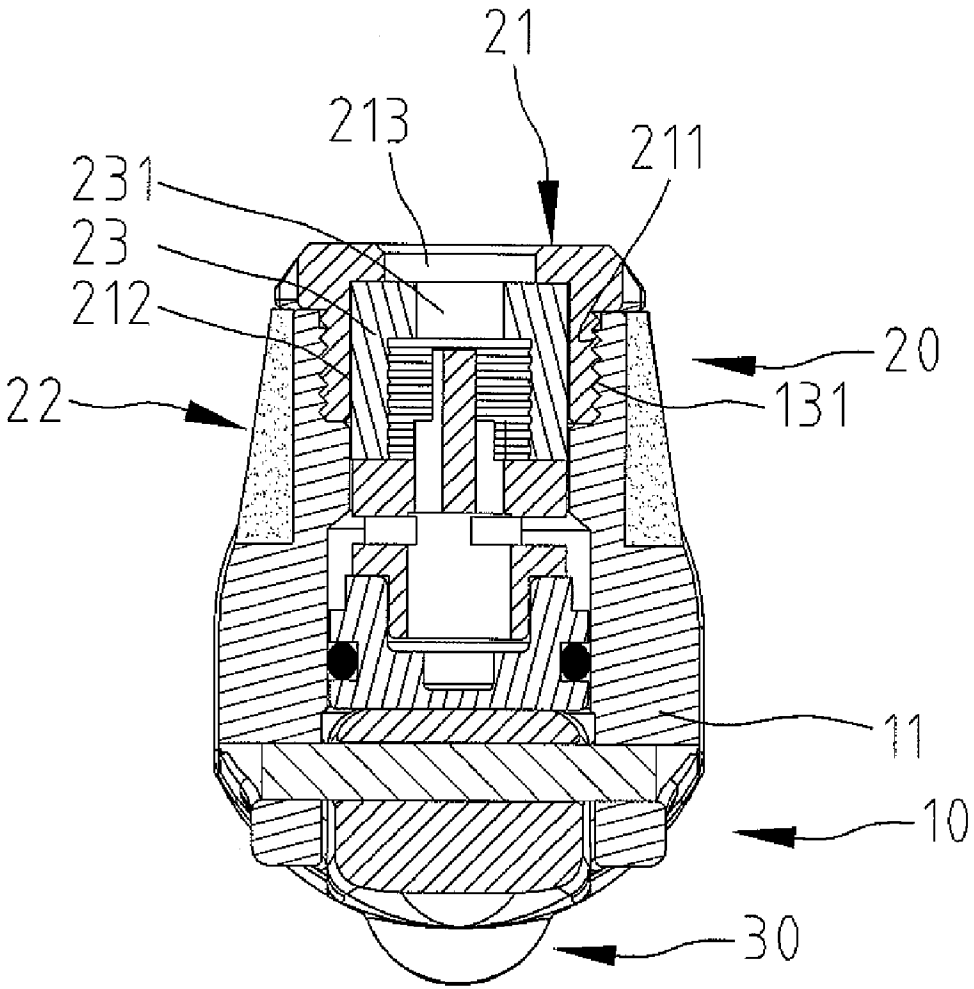
FIG. 6 is a sectional view taken along plane 6-6 in FIG. 1.
Figure 7:
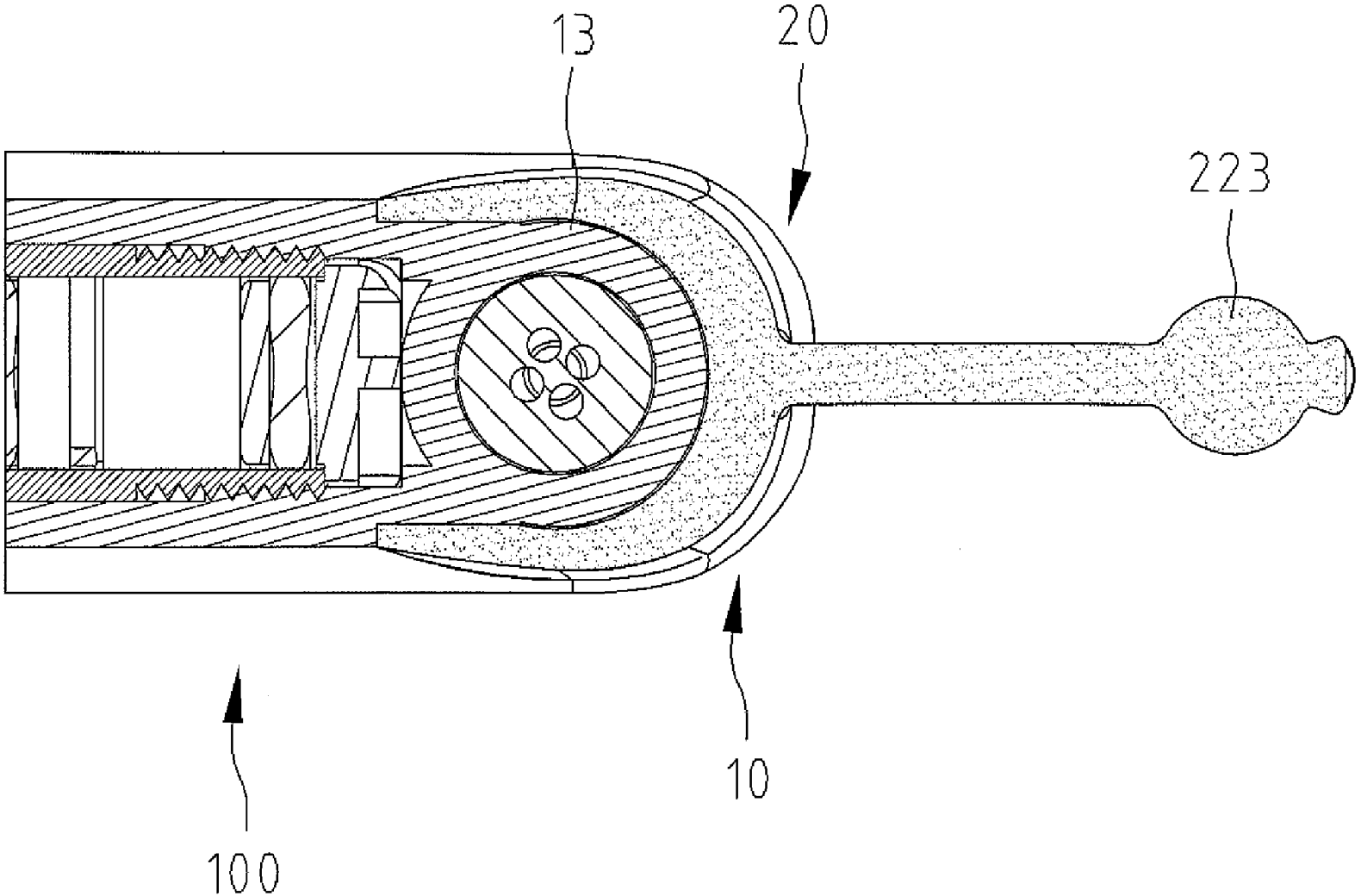
FIG. 7 is a top view in accordance with FIG. 1.
Figure 8:
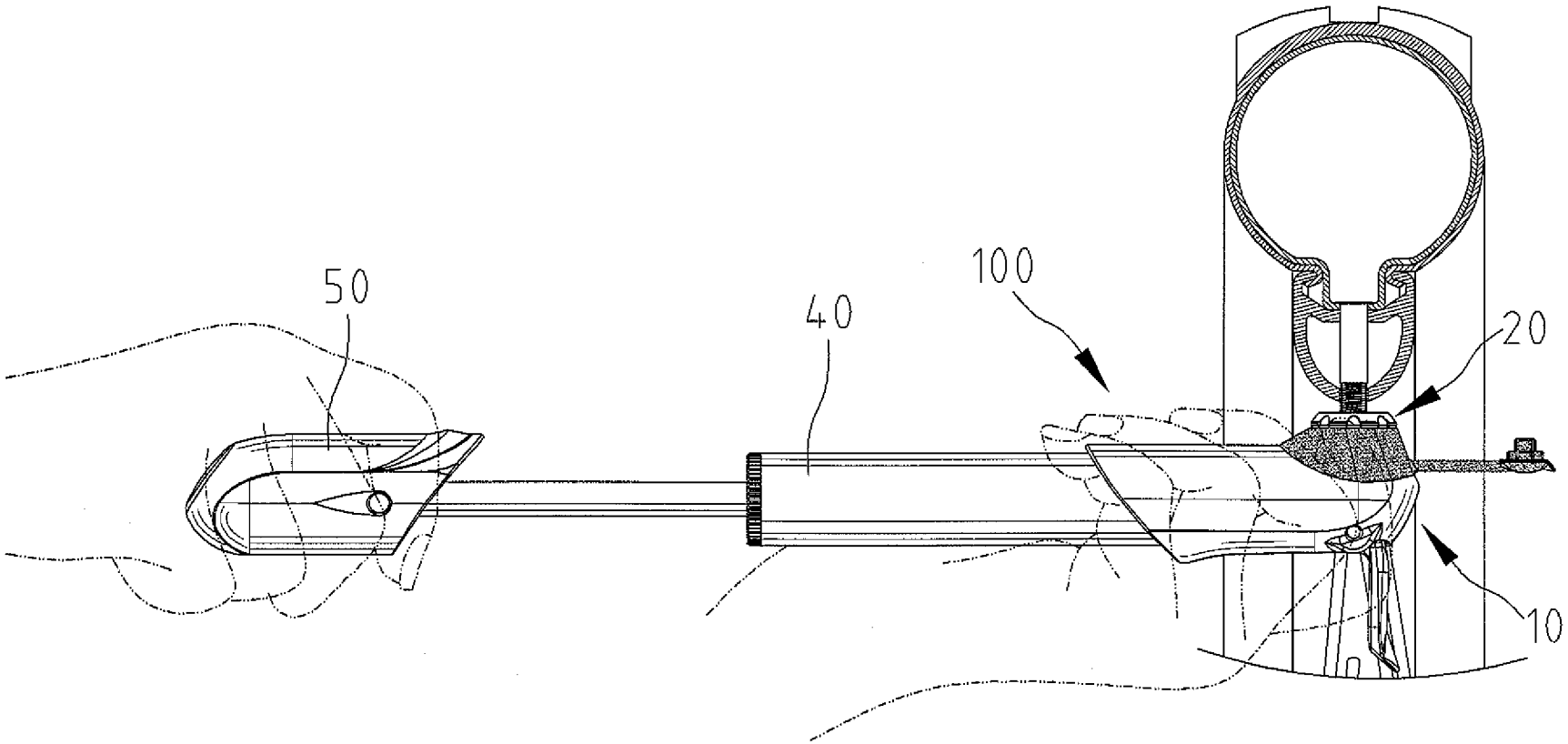
FIG. 8 illustrates a user holding the mini pump in accordance with the present invention to inflate the bicycle tire.
Figure 9:
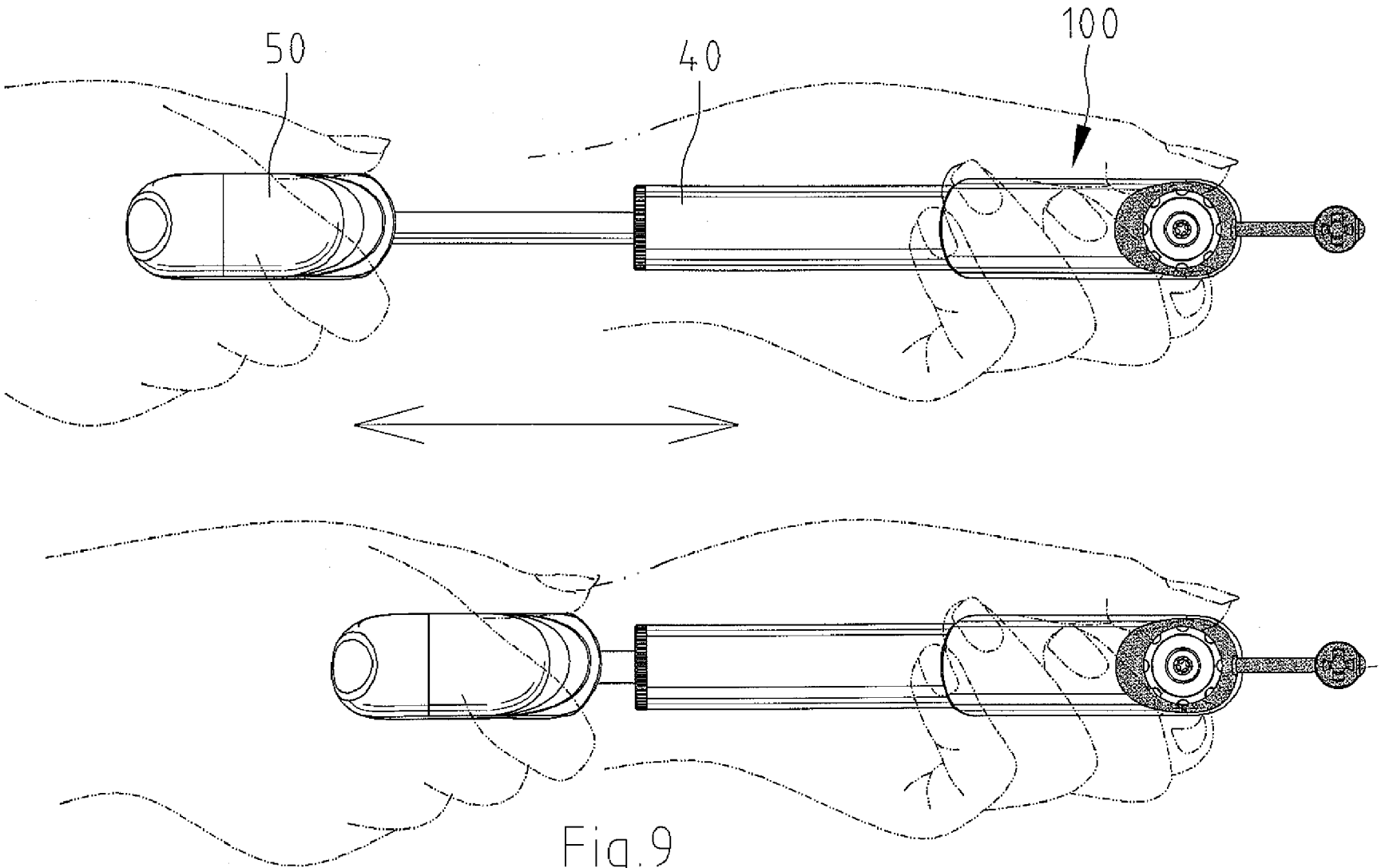
FIG. 9 illustrates a user operating the mini pump in accordance with the present invention.
Figure 10:
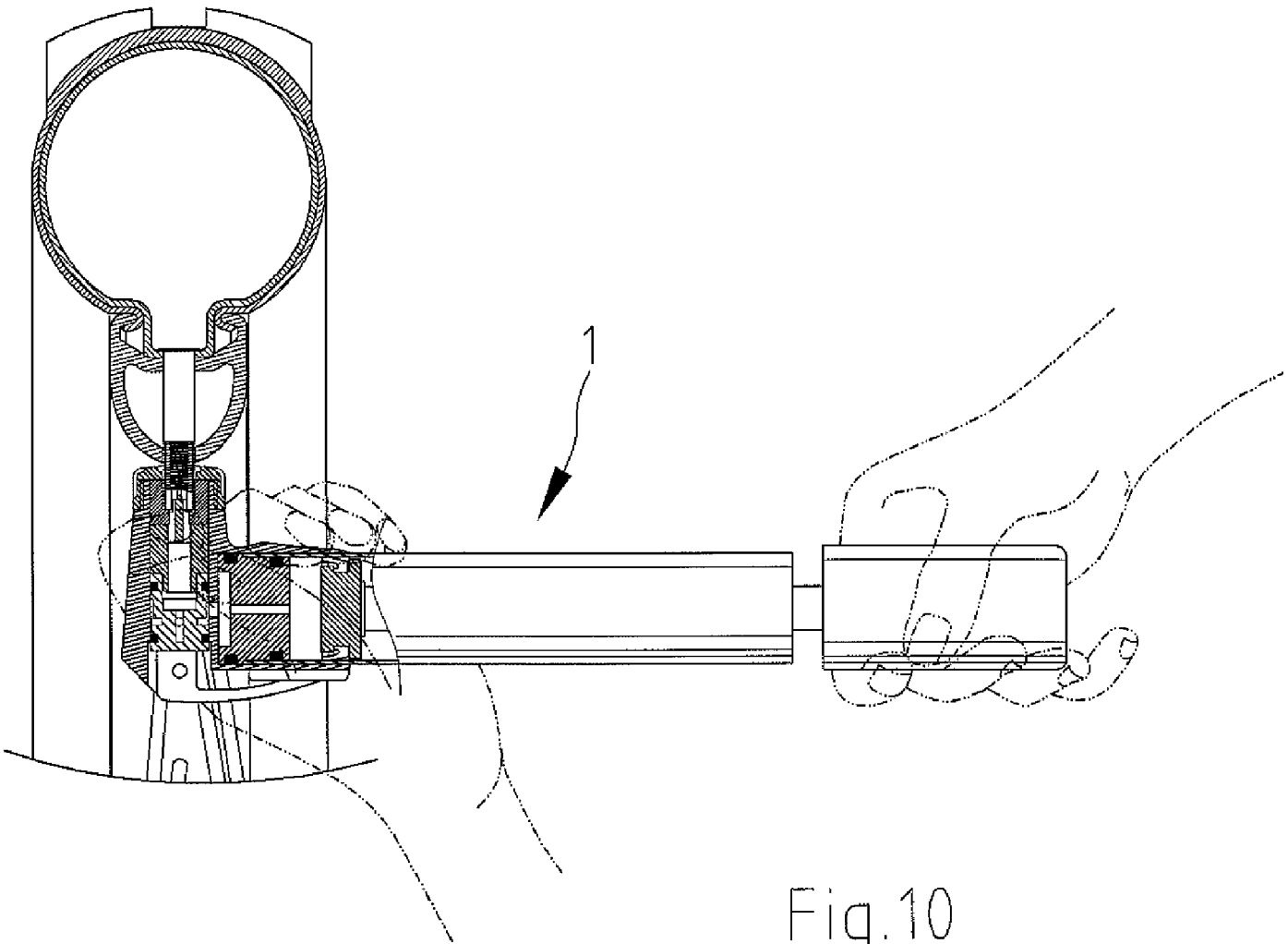
Fig.10 PRIOR ART
FIG. 10 illustrates a conventional mini pump held by a user for inflating the bicycle tire.

A mini pump 100 according to the preferred embodiment of the present invention is shown in the drawings. The mini pump 100 includes a tube 40, a body 10 coupling to an end of the tube 40, a handle 50 disposed on another end of the tube 40, a nozzle device 20 mounted on the top of the body 10, and a locking device 30 which is installed on the bottom of the body 10 via a pin (not numbered) and being opposite to the nozzle device 20.

The body 10 includes a head 11 formed on an end thereof, a hollow tube-shaped handheld portion 12 defined on another end thereof, and a cylinder 13 disposed on the head 11. The head 11 includes an U-shaped groove 111 formed around the outside periphery of the cylinder 13. A concavity 112 is defined around the outside periphery of the cylinder 13 opposite to the U-shaped groove 111 on the top of the body 10, and two ears 113 are disposed on the bottom of the body for installing the locking device 30 thereto by the pin (not numbered). The handheld portion 12 defines a compartment 121 for receiving the tube 40 therein, with the compartment 121 having an engaging portion 122 therein adjacent to the cylinder 13. The cylinder 13 includes a threaded portion 131 formed on the inner wall of an end thereof and a receiving portion 132 therein.

The nozzle device 20 includes a cover element 21. An anti-sliding element 22 abuts with a nozzle 23 and is disposed onto the head 11. The nozzle 23 is received in the cylinder 13 and couples with the cover element 21. The cover element 21 includes a cover portion 211 defined on an end thereof, an engaging portion 212, which is formed on another end thereof and engages with the threaded portion 131 of the cylinder 13, and a through hole 213 defined therethrough and mounted on the nozzle 23.

The anti-sliding element 22 is hollow and defines a compartment 224 therein. The compartment 224 receives the cylinder 13 and the engaging portion 212 of the nozzle device 20 with the cover portion 211 abutting against the upper periphery thereof. The anti-sliding element 22 further includes a first positioning portion 221, which extends from the bottom periphery of the anti-sliding element 22 and is disposed in the U-shaped groove 111 of the body 10, a second positioning portion 222 corresponding to and disposed on the concavity 112 of the body 10 opposite to the first positioning portion 221 as to locate the anti-sliding element 22 on the body 10 stably, and a plug element 223 extending from a side of the anti-sliding element 22 and provided to cover the through hole 213 of the cover element 21.

The nozzle 23 has a hole 231 therein, with the hole 231 communicating with the through hole 213 of the cover element 21 and the compartment 121 of the handheld portion 12.

The cover element 21 is disposed on the top of the nozzle 23. The engaging portion 212 engages with threaded portion 131 of the cylinder 13, and the cover portion 211 covers the top periphery of the anti-sliding element 22 and the cylinder 13 as to prevent the nozzle 23 and the anti-sliding element 22 from coming off the mini pump.

The tube 40 has an engaging portion 41 formed on an end thereof and adapted for engaging with the engaging portion 122 of the handheld portion 12 for coupling the tube 40 to the body 10 of the mini pump, A through-hole 42 is formed in the tube 40 communicating with the compartment 121 of the handheld portion 12. The tube 40 is preferably made of metal, like aluminum or iron, because the metal tube has better roundness than a plastic tube. Increasing roundness can enhance its capability and further save production cost.

The handle 50 is mounted onto the tube 40 opposite to the body 10 for users to operate when utilizing the mini pump to inflate. The locking device 30 is adapted to lock/release the nozzle device 20 with the tire while inflating.

The anti-sliding element 22 of the nozzle device 20 and the handheld portion 12 of the body 10 both are preferably made from resin in the present invention. However, the hardness of the anti-sliding element 22 of the nozzle device 20 is softer than that of the handheld portion 12 of the body 10. While a user operates the mini pump 100 in accordance with the present invention, the user could hold the handheld portion 12 of the body 10 in his palm, and his fingers can grip the anti-sliding element 22 of the nozzle device 20 for steady inflating and for preventing the mini pump from coming off the user's hand. When the user operates the mini pump for inflating, a force is applied on the pump, and the user's hand might be sweating. It might cause the pump to slip from the user's hand. Hence, the user can grip the soft resin material of the anti-sliding element 22 stably and comfortably, insuring operation safety.

Furthermore, parts of the body 10 of the mini pump 100 are simple and easy to fabricate. The anti-sliding element 22 and the handheld portion 12 are respectively manufactured via injection-molding, and, then, the parts are fabricated in sequence. The method of fabrication can tighten the anti-sliding element 22 with the body 10. Therefore it is unnecessary to use the bicolor injection molding machine to produce the anti-slipping element and the handheld portion of the mini pump so that a mini pump in accordance with the present invention be produced to can save cost and simplify the production process.

Thus since the invention disclosed herein may be embodied in other specific forms without departing from the spirit of the general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. A mini pump comprising:

a body including a head formed on an end thereof, a handheld portion defined on another end thereof and a cylinder protruding from a top of the head;

wherein the head forms a groove encompassing an outer periphery of the cylinder, and the handheld portion defines an engaging portion on an inner wall adjacent to the cylinder;

a nozzle device including an anti-sliding element mounted on the head and a nozzle received in the cylinder;

wherein the anti-sliding element includes a compartment for receiving the cylinder, and a first positioning portion extending from a bottom periphery of the anti-sliding element and inserted into the groove;

a tube inserted into the handheld portion and having an engaging portion for engaging with the engaging portion of the handheld portion as to fix the tube to the body; and a cover element including a cover portion and an engaging portion, with the cylinder including a threaded portion for engaging with the engaging portion in the compartment of the anti-sliding element, with the cover portion adapted for abutting with a top periphery of the anti-sliding element and the cylinder as to fix the anti-sliding element onto the head.

2. the mini pump as claimed in claim 1, with the anti-sliding element having a second positioning portion opposite to the first positioning portion, with the head defining a concavity corresponding to and receiving the second positioning portion for further stably disposing the anti-sliding element of the body.

3. The mini pump as claimed in claim 1, with the cover element having a through hole, with the handheld portion having a compartment therein, with the nozzle defining a hole therein for communicating with the through hole and the compartment respectively.

4. The mini pump as claimed in claim 1 further comprising a handle mounted on an end of the tube opposite to the body.

5. The mini pump as claimed in claim 3, with the anti-sliding element having a plug element adapted to stuff up the hole for dust-proofing.

6. The mini pump as claimed in claim 1 further comprising a locking device disposed on a bottom of the head opposite to the cylinder.

7. The mini pump as claimed in claim 6, with the head having two ears adapted to install the locking device thereon.

* * * * *